United States Patent [19]

Elkins

[11] 4,401,163

[45] Aug. 30, 1983

[54] MODIFIED IN SITU RETORTING OF OIL SHALE

[75] Inventor: Lincoln F. Elkins, Oklahoma City, Okla.

[73] Assignee: The Standard Oil Company, Cleveland, Ohio

[21] Appl. No.: 220,645

[22] Filed: Dec. 29, 1980

[51] Int. Cl.[3] ..... E21B 43/247

[52] U.S. Cl. ..... 166/259; 166/65 R; 166/303

[58] Field of Search ..... 166/259, 256, 303, 272, 166/65 R

[56] References Cited

U.S. PATENT DOCUMENTS

| | | | |
|---|---|---|---|
| 3,273,640 | 9/1966 | Huntington | 166/303 X |
| 3,291,215 | 12/1966 | Nichols | 166/259 |
| 3,294,167 | 12/1966 | Vogel | 166/272 |
| 3,379,248 | 4/1968 | Strange | 166/256 |
| 3,454,958 | 7/1969 | Parker | 166/256 |
| 3,548,938 | 12/1970 | Parker | 166/256 |
| 3,987,851 | 10/1976 | Tham | 166/256 |
| 3,994,343 | 11/1976 | Cha et al. | 166/259 |
| 4,019,577 | 4/1977 | Fitch et al. | 166/259 |
| 4,059,308 | 11/1977 | Pearson et al. | 166/259 X |
| 4,169,506 | 10/1979 | Berry | 166/259 X |

*Primary Examiner*—Stephen J. Novosad

*Attorney, Agent, or Firm*—Salvatore P. Pace; Herbert D. Knudsen; Larry W. Evans

[57] ABSTRACT

Hot retorting gas for pyrolysis of kerogen in a bed of rubblized oil shale is supplied by a pressure pulsing technique.

25 Claims, 18 Drawing Figures

PRESSURE PULSE METHOD RETORTING OF OIL SHALE

SEQUENTIAL OPERATION OF RUBBLIZED IN SITO OIL SHALE RETORTS

COMBUSTION IN 'B'

HEAT TRANSFER AND PYROLYSIS IN 'C'

LAYOUTS OF BEDS IN SINGLE PANEL OF OIL SHALE

PANEL OF 12 BEDS

LAYOUT OF FOUR ASSOCIATED BEDS IN DOUBLE TANDEM ARRANGEMENT AND ASSOCIATED PIPING

LAYOUT OF PANELS OF BEDS AND ASSOCIATED TREATMENT

PANEL OF 12 BEDS

PRESSURE PULSE OPERATION DURING COMBUSTION

PRESSURE PULSE OPERATION DURING HEAT TRANSFER

MODIFIED IN SITU RETORTING OF OIL SHALE

BACKGROUND OF THE INVENTION

The present invention relates to a new technique for retorting oil shale in situ, i.e. without removing it from the ground.

Oil shale is a naturally occurring rock formation which contains an organic material called kerogen. Laboratory tests have shown that when oil shale is heated to high temperatures in the absence of oxygen, the kerogen pyrolyzes to form hydrocarbon gases, shale oil vapors, shale oil liquids and a residual coke product. The hydrocarbon gases can be recovered as a gas while the shale oil vapors can be condensed and recovered together with shale oil liquids as shale oil. The coke and some of the shale oil liquids remain in the rock formation.

Retorting With Hot Gases

Many techniques have been proposed for recovering shale oil from oil shale on a commercial basis. In many of these techniques heat for pyrolysis is supplied by hot gases. For underground processes, usually this hot gas takes the form of flue gas produced by combusting the kerogen and/or char in the shale itself. In such processes, known as combustion retorting, air is supplied to one end of a raw shale bed or formation where it initially causes combustion of the kerogen therein. Flue gas produced by such combustion passes through the shale bed or formation where it causes pyrolysis of additional kerogen. The kerogen decomposition products, e.g. shale oil and gas, together with the flue gas are withdrawn from the other end of the shale bed or formation. Continuous supplying of air causes a combustion or flame front to pass through the bed or formation with the flue gas continuing to pyrolyze kerogen and the residual char being combusted until the flame front reaches the outlet end of the bed or formation.

In addition to hot flue gas, steam and hot shale gas produced from an adjacent shale bed or formation or heated at the surface have been proposed for use as a hot retorting gas.

Above Ground Retorting

Many different approaches have been suggested and tested for accomplishing hot gas (and specifically combustion) retorting in a commercially feasible manner. Most early work was based on above ground retorting in which shale is mined, brought to the surface, crushed, screened and pyrolyzed in above ground retorts. Because the amount of shale oil recoverable from oil shale is only about 10 to 50 gallons per ton, a great deal of mining and huge retorts are needed, and hence this technique is expensive.

True In-Situ Retorting

Another approach involves the in situ recovery of shale oil wherein oil shale is pyrolyzed underground.

One technique for in situ retorting, known as true in situ retorting, involves creating fractures in a shale formation and then passing the hot retorting gas through the cracks and fissures to retort the adjacent shale. Hot flue gas produced by combusting the shale is usually proposed as the retorting gas although steam has been suggested and tried.

Results of such techniques have been singularly unsuccessful. See, for example, Evaluation of Rock Springs Site 9 In Situ Oil Shale Retorting Experiment, Long et al., 10th Oil Shale Symposium Proceeding, Colorado School of Mines, July 1977, which reports that field tests conducted by the Laramie Energy Technology Center (U.S. DOE) in the shallow Tipton shale near Rock Springs, Wyoming resulted in shale oil recovery of only 1% or so of Fischer assay.

Modified In-Situ Retorting

Another technique for in situ retorting is known as modified in situ retorting. This technique differs from true in situ retorting in that flow paths for transmission of gases through the shale are created by breaking up the shale into rubble. An apparent disadvantage of true in situ retorting is that cracks or fissures in a shale formation even if artifically induced and/or enlarged by explosives do not allow sufficient heat and mass transfer. Modified in situ retorting seeks to overcome this disadvantage by rubblizing discrete sections or beds of the oil shale to produce a much greater amount of available flow path and hence heat and mass transfer capacity.

Rubblization

Rubblization of the shale oil bed in modified in situ retorting involves breaking up a coherent bed of shale into shale pieces or chunks (hereinafter "chunks") and rearranging or stirring the shale into a new arrangement. In other words, more than simple fracturing of a shale formation is needed. The pieces and chunks of shale must be rearranged whereby significant flow paths defined by the interstices between the shale chunks are created and distributed throughout the rubblized mass with reasonable uniformity.

Rubblization of a shale bed to form an underground pile of shale rubble can be accomplished in a number of ways. Weichman teaches removing shale from a shale formation, crushing the shale and then redepositing the 4 inch and larger pieces of crushed shale back into the hollowed out shale formation. See "Saline Zone" Oil Shale Development by the Integrated In Situ Process, Symposium Papers, Synthetic Fuels from Oil Shale, sponsored by Institute of Gas Technology, December 1979. Above ground simulation of in situ pyrolysis of a rubble bed made in this manner has been shown to provide shale oil product in amounts of 80 to 90% of Fischer assay, which is an excellent recovery. See In Situ Oil Shale, 3rd Briefing on Oil Shale Technology Research, Lawrence Livermore National Laboratory, Nov. 19–21, 1980. However, removing shale from a shale bed, crushing it and then returning it to the bed eliminates one of the major advantages of the in situ process, namely minimizing mining costs.

The most popular technique for forming a rubblized shale bed underground is explosive rubblization in which shot holes are drilled in the roof, walls and floor of drifts or adits, the shot holes filled with an explosive and the explosive detonated. The ensuing explosion breaks up the shale formation into pieces and rearranges the pieces into a rubblized pile. See Karrich, U.S. Pat. No. 1,913,395.

Unsuccessful Attempts At Commercial Practice

Actual and simulated tests of modified in situ combustion retorting on a commercial and near-commercial scale have been unsuccessful. For example, from the mid-1960's to the mid-1970's, the U.S. Bureau of Mines (now U.S. DOE) at Laramie, Wyoming, conducted above ground simulations of the modified in situ combustion retorting process in a 10 ton and a 150 ton batch retort using shale mined from the Mahogany layer of the Green River shale formation located in Colorado, Utah and Wyoming in the western United States. In some tests, large pieces of shale up to 4 by 5 by 6 ft. were included. The highest shale oil recoveries achieved were on the order of 60 to 66% of Fischer assay. See Oil Shale Retorting in a 150 Ton Batch-Type Pilot Plant, U.S. Bureau of Mines R.I., 7995 (1974).

Similarly, Ocidental Oil Shale Company, by itself and under contract with the U.S. DOE, has conducted field tests of vertical modified in situ combustion retorting of oil shale. In "vertical" retorting the gases pass through the bed vertically. Three initial tests were conducted with smaller retorts approximately 30 to 35 ft. square and 72 to 114 ft. high. Recoveries on the order of 62% of Fischer assay were reported. See OXY Modified In Situ Process Development and Update, McCarthy and Cha, Proceedings of Ninth Oil Shale Symposium, Colorado School of Mines, October 1976. In the next three tests, larger retorts approaching commercial size were employed, these retorts measuring on the order of 120 to 160 ft. square and 160 to 260 ft. high. The recoveries realized were only 21 to 39% of Fischer assay. See Occidental Vertical Modified In Situ Process for the Recovery of Oil from Oil Shale: Phase 1 U.S. DOE TID-28053/1 NTIS November 1977, and In-Situ Oil Shale, 3rd Briefing on Oil Shale Technology Research at Lawrence Livermore National Laboratory, Nov. 19–21, 1980.

In still another area, Geokinetics, Inc., under contract with the U.S. DOE, has conducted field tests of horizontal modified in situ combustion retorting on a shale bed with a very limited overburden, 0 to about 50 ft. Because of the very small overburden, shot holes could be drilled into the shale formation from the surface rather than through drifts and adits. In these tests, the rubblized shale retorts ranged from 10 to 62 ft. wide by 30 to 87 ft. long in horizontal dimensions and 3 to 23 ft. in thickness. Results showed that shale oil was recovered only in amounts of 22 to 65% of Fischer assay. See "Synthetic Fuels", Cameron Engineers, Inc., Vol. 16, No. 2, June 1979.

Extensive tests conducted by Lawrence Livermore National Laboratories, the Laramie Energy Technology Center (DOE), the above companies and others have established that one reason for the low shale oil recoveries in actual and simulated modified in situ retorting of oil shale is severe channeling of gas flows through a rubblized bed. Thus, rather than having a flame front pass relatively uniformly through a rubble pile, some parts of the flame front pass quickly through the bed and reach the outlet end (oxygen breakthrough) while other parts of the flame front are still relatively upstream. When significant amounts of oxygen reach the outlet end of the bed, the oxygen will burn shale oil and shale gas products at high temperatures requiring stopping of the retorting processes before all shale in the bed has reached pyrolysis temperatures. This reduces the overall shale oil recovery efficiency.

The tests conducted by Lawrence Livermore National Laboratories and The Laramie Energy Technology Center (DOE) have also established with fairly high certainty a second reason for reduced shale oil recovery in in situ combustion retorting of rubblized shale. The chunks of shale created by explosive rubblization vary widely in size. The very large pieces of shale heat up much more slowly than the small pieces. Thus, much of the shale oil generated in the larger pieces is produced after the flame front has passed and oxygen is present. Not only is part of this oil burned but the very hot combustion products contact other shale oil cracking it to coke and gases.

These negative effects of channeling could be reduced by withdrawing rubblized shale from the bed, crushing, screening to a uniform size and returning it to the bed as suggested by Weichman, supra. Because of the mining, crushing and screening costs, however, this solution is economically disadvantageous where other minerals are not to be recovered also.

The severe channeling problem could also be reduced by appropriate accomplishment of the explosive rubblization procedure. As is well known, the uniformity in size as well as distribution of shale chunks produced by explosive rubblization is dependent on how the explosion is carried out. As the number of shot holes in a particular formation increases and as the amount of explosive increases the rubble pile produced becomes more nearly uniform in size. Theoretically, it might be is possible to explosive rubblize a shale formation so that the resultant rubble pile has a shale chunk size and spacial distribution approaching that of mechanically crushed and screened shale. However, the amount of drilling and explosives needed make this alternative prohibitively expensive. As a practical matter, therefore, shale rubble produced by in situ explosive rubblization will contain shale chunks of widely varying sizes distributed in a non-uniform fashion.

Still another technique for overcoming the drawbacks of channeling is described in the Pearson patent, U.S. Pat. No. 4,059,308. This patent totally rejects explosive rubblization as being unworkable and adopts instead a leaching procedure to dissolve and remove naturally occurring water-soluble minerals in the shale and thereby provide suitable porosity for gas transfer. Unfortunately, this technique can only be improved on a comparatively small number of shale formations.

Accordingly, it is an object of the present invention to provide a new process for recovering shale oil from oil shale in a modified in situ retorting mode based on hot gas retorting of explosive rubblized shale that overcomes to a large degree the deleterious effects of channeling and variations in size and packing of shale chunks and which offers additional benefits and increased recovery of shale oil not available to modified in situ combustion retorting as now practiced.

SUMMARY OF THE INVENTION

This and other objects are accomplished by the present invention which adopts a system approach using a number of integrated features to ameliorate the adverse effects of channeling and of unequal rates of heating different sized pieces of shale which occur in modified in situ combustion retorting of an explosive rubblized shale bed. In accordance with the invention, the combustion function and the pyrolysis function of conventional in situ combustion retorting are separated from one another (i.e. carried out in separate beds) and process gases for both functions are supplied in a pressure pulsing mode. By these expedients, the adverse effects of channeling and of burning of part of the shale such as occur in in situ combustion retorting of oil shale can be significantly reduced and the amount of shale oil recoverable from the shale formation significantly increased.

In a preferred embodiment, the heat for pyrolysis of kerogen in one raw shale bed is generated by combustion of char in an adjacent spent shale bed and stored temporarily as sensible heat in that bed. Periodically combustion of char is stopped and an oxygen-free gas circulated in sequence through the hot spent shale bed and then into the raw shale bed to heat and pyrolyze the kerogen. Judicious timing of the combustion and heat transfer sequences allows the maximum temperature of the raw shale bed during pyrolysis to be precisely controlled, thereby avoiding cracking of shale oil.

Thus, the present invention provides a novel process for retorting a discrete bed of raw oil shale to produce shale oil therefrom comprising (a) rubblizing the bed, and thereafter (b) heating the bed to cause pyrolysis of the kerogen therein, the heating being accomplished by supplying a hot retorting gas to the bed in such a manner that the pressure in the bed cycles between higher and lower pressures, whereby the hot retorting gas causes pyrolysis of the kerogen.

DETAILED DESCRIPTION

In accordance with the present invention, combustion retorting of a rubblized shale bed is accomplished by separating the combustion function and the pyrolysis function, by supplying and withdrawing all process gases in both functions by a pressure pulsing technique and by precisely controlling maximum bed temperature during pyrolysis to avoid cracking of shale oil liquids into coke.

The concept of separating the combustion function from the pyrolysis function (i.e. carrying out pyrolysis and combustion in different beds) in the combustion retorting of rubblized shale beds is already known. See Karrick, U.S. Pat. No. 1,913,395. However, no operating procedure or mechanical arrangement is taught therein which will effectively combust char in a spent shale retort and transfer the heat therefrom to a raw shale retort without oxygen entering the raw shale retort.

In contrast, this invention provides an operating procedure which permits using the fuel value of the char in a spent shale retort and the sensible heat in a burned shale retort to provide the heat necessary to pyrolyze the kerogen in a raw shale retort and at the same time prevents burning of shale oil through inadvertent entry of oxygen into the hot raw shale retort.

Supplying and withdrawing process gases from a shale oil formation by pressure pulsing is also known. See Pearson, U.S. Pat. No. 4,059,308. However, the process disclosed therein is applicable only to certain specific shale formations containing certain water-soluble minerals in addition to kerogen. It is not applicable to the vast majority of oil shale deposits which have little or no water-soluble minerals.

In accordance with this invention, pressure pulsing and separating combustion and pyrolysis are combined so that (1) the possibility of mixing oxygen from the combustion function with shale oil gas and vapor from the pyrolysis function is eliminated and (2) gas/solid contact during both functions is maximized. In addition, heat for pyrolysis is supplied in accordance with the invention by forced convection using a technique enabling precise control of the pyrolysis temperature, thereby avoiding cracking of valuable shale oil product.

Pressure Pulsing

Figure 1:
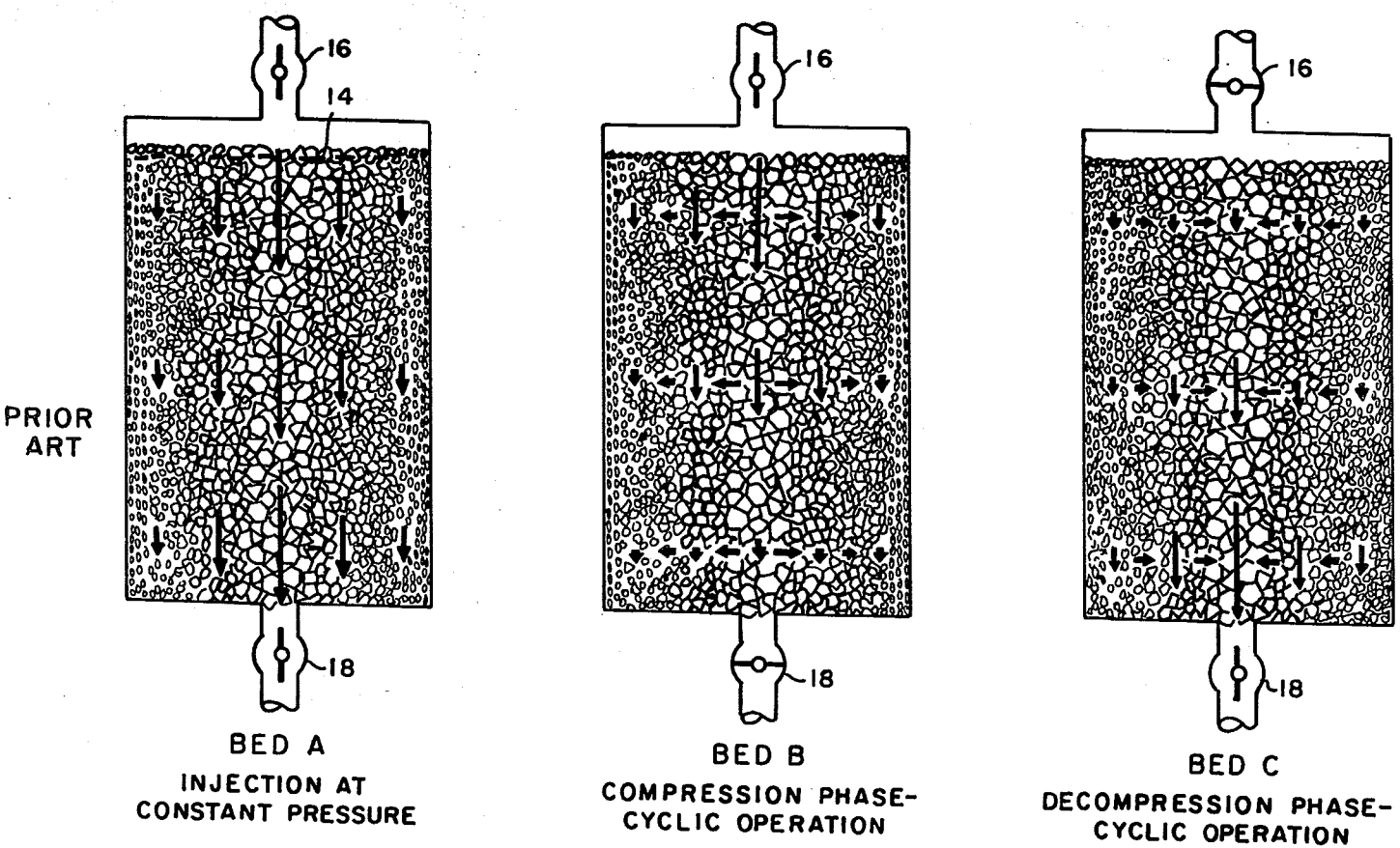
FIG. 1 is a schematic illustration of a number of rubblized oil shale beds being contacted with various process gases by the prior art constant pressure technique and the pressure pulsing technique of the present invention.

The advantages of supplying and withdrawing process gases to rubblized beds by pressure pulsing may more easily be appreciated by reference to FIG. 1. This figure shows three shale oil beds, Bed A being operated at constant pressure in accordance with the conventional prior art modified in situ combustion retorting and Beds B and C being operated in a pressure pulsing mode.

Each of Beds A, B and C are oil shale beds which have been previously rubblized. In operation, a gas is introduced via inlet 16 so that it passes through the bed and is discharged via outlet 18. In the case of combustion retorting in Bed A, combustion is initiated at the inlet end of the bed so that a combustion front 14 is established, air entering the bed via inlet 16 being transformed into flue gas at the combustion front for ultimate discharged through outlet 18.

In actual practice, it is not possible to rubblize an oil shale bed in such a way that the rubble produced is reasonably uniform in size. This is illustrated in the figure where it can be seen that in the central portion of the bed the chunks are much larger than at its periphery. In actual practice, areas of larger rubble chunks may be located anywhere in the bed.

The non-uniformity in rubble size leads to significant problems. In areas where the rubble chunks are large, the interstices between the chunks are large, and hence the flow paths through the rubble are large. Conversely, in areas in which the rubble is smaller, the flow paths are smaller. As a result, the flow of gas through the bed is non-uniform. This is reflected by the arrows in Bed A which schematically show that in the central area of the bed the gas flow rate is high, while in outlying areas the gas flow rate is correspondingly smaller.

The overall result of this is that heat and mass transfer efficiencies are reduced. For example, because of the non-uniform flow rate, combustion front 14, rather than traveling essentially uniformly through Bed A travels quickly through Bed A in its central portion but much more slowly in its periphery. As a result, much of the kerogen in the periphery of the bed is not pyrolyzed before the combustion front reaches outlet 18 and hence oxygen breakthrough. Once oxygen breakthrough occurs, the efficiency of the process is drastically reduced since pyrolysis products such as vaporous shale oil come into contact with and are combusted by the oxygen in the outlet gas and therefore the operation must be stopped for reasons of safety. Also in areas where the shale chunks are large, much of the shale gas and liquids do not issue from the chunks until after the combustion front passes and, hence, are combusted by the surrounding oxygen. Localized hot spots also cause cracking of shale oil product into shale gas and coke in areas where no oxygen is present.

In accordance with the present invention, such problems are significantly reduced by the expedient of employing a pressure pulsing operaton for gas/rubble contacting in both combustion and pyrolysis operations. This operating technique is illustrated with respect to the pyrolysis function in Beds B and C, Bed B being operated in a compression mode and Bed C being operated in a decompression mode. In Bed B a retorting gas is introduced into inlet 16, this retorting gas comprising a hot oxygen-free gas, preferably hot shale gas. During this time, outlet 18 of Bed B is closed so that the gas pressure in Bed B builds to a predetermined value. Then as illustrated in Bed C valve 18 is opened and valve 16 is closed so that charging of retorting gas is terminated and the gas already in Bed C is discharged. When the pressure in Bed 18 drops to a predetermined value, the valves are again changed so that the compression phase of the cyclic operation can be started again.

The advantage of this pressure pulsing method of operation are three-fold. First, channeling effects due to irregularly sized and distributed rubble are largely ameliorated. This is illustrated by the schematic arrows in Beds B and C where it can be seen that gas passing into the central channel of the bed is no longer free to simply pass through the channel but must be distributed to the periphery of the bed until equilibrium pressure is reached. Similarly, on decompression, the absence of incoming retorting gas enables gas in the periphery of the bed to reach the larger channels in the interior of the bed and be discharged.

The second advantage of pressure pulsing is that contact between the gas and individual rubble pieces is more intimate. A shale chunk has some permeability to gas due to pressure of cracks or fissures in the chunk. As the kerogen is pyrolyzed and converted to gases, vapors and liquids, the shale develops porosity and permeability within the shale matrix itself. Contact of the gas with the shale chunk will occur, therefore, not only on the chunk's outer surface, but also in its interior. In normal operation as illustrated in Bed A, the gas pressure remains essentially constant. In this mode, there is nothing except diffusion to force gas into and out of individual pores and interstices in the chunk. In pressure pulsing, however, the increases and decreases in pressure continuously force gas into and out of the pores and interstices of the chunk, thereby significantly increasing the overall gas/solid contact. Thus, pressure pulsing leads to a much more intimate and efficient contact between a gas injected into the bed and the shale. This will accelerate the combustion of char in spent shale and it will accelerate the heat transfer to raw shale in larger chunks of shale. Such improvement in these processes will permit the retorting of larger chunks of shale and reduce the constraints placed on the explosive shale rubblization process.

The third advantage of pressure pulsing is that contact of "dry" retort gas with liquid shale oil within each chunk of shale will increase the recovery of shale oil over that attainable by pyrolysis at substantially constant pressure. Laboratory experiments have indicated that there is more shale oil liquid generated in chunks of shale than can be vaporized before the retort temperatures become high enough to crack or coke the oil. However, other laboratory experiments have demonstrated that passage of a sweep gas through very fine powdered shale during pyrolysis vaporizes additional shale oil by contact with this oil on the surface of the powder or by contact with this oil near the surface of the powder by diffusion. By injecting a hot oxygen-free gas into a rubblized raw shale retort in a pressure pulsing mode, the "dry" retort gas (i.e. retort gas not saturated with the shale oil liquid) will penetrate the individual pores and interstices in each chunk of shale, come into intimate contact with this liquid shale oil vaporizing part of it, and remove it from the shale during the de-pressuring part of the pressure pulse cycle. This vaporization of additional shale oil is enhanced by operation of the retort at the lowest absolute pressure possible. The preferred method of operation involves swings from a maximum pressure of substantially atmospheric pressure (11 to 12 psia at the locale of much of the Green River Oil Shale in Colorado and Utah) to a minimum pressure of about 5 to 9 psia. The pressure swings appropriate for each operation will depend on an economic balance between the additional shale oil vaporized and the investment and operating cost for compression and other factors readily apparent to those skilled in the art.

Separating Combustion and Pyrolysis Functions

In carrying out the inventive process, combustion and pyrolysis are carried out in separate beds and the heat developed in the bed being combusted is used as the heat source for pyrolysis. This is already shown in the Karrick patent. However, in accordance with this invention, this is accomplished by a mode of operation which prevents contamination of the shale gas product with oxygen or flue gas and which allows precise control of the pyrolysis temperature.

Figure 2A:
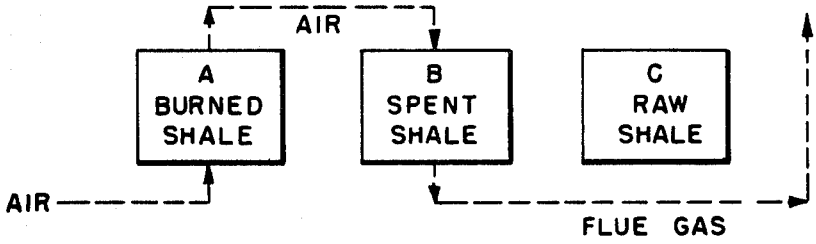
FIGS. 2A and 2B are schematic views of a series of shale oil beds illustrating a part of the sequential operation technique of the present invention.
Figure 2B:
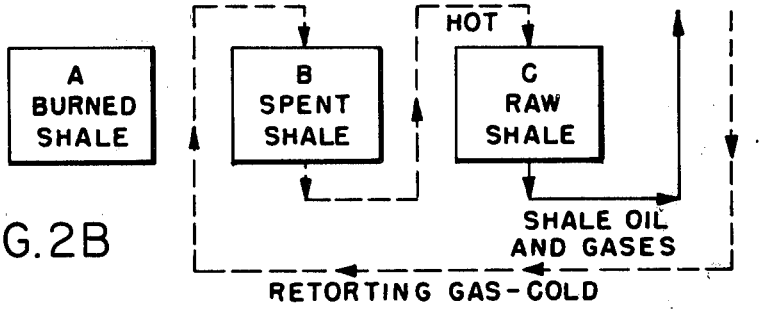

FIGS. 2A and 2B, which show the sequential operation of three associated rubblized oil shale beds, illustrate this aspect of the invention. In both figures Bed A is a rubblized bed of burned shale, Bed B is a rubblized bed of spent shale, while Bed C is a rubblized bed of raw shale. The sensible heat in Bed A and Bed B as well as the heat of combustion of the char in Bed B are to be used to retort raw rubblized shale Bed C without contamination of the product with flue gas or air and further by a technique which allows precise control of the maximum temperature of the hot pyrolysis gas passing into Bed C and hence the pyrolysis temperature therein.

In operation, the beds are first operated in the mode illustrated in FIG. 2A. Namely, air is injected into burned shale Bed A for preheating and then into spent shale Bed B for the burning of char. The flue gas produced thereby is used to generate steam and discharged to waste. After a suitable period of time, this operation is terminated and the beds are then operated in accordance with FIG. 2B. Specifically, cold oxygen-free retorting gas is injected into Bed B where it is heated and then into raw shale Bed C where it pyrolyzes the kerogen therein. Injected retorting gas together with the shale oil vapors and gases produced by pyrolysis are discharged from raw shale Bed C as product. After another suitable period of time when the temperature of the retort gas has declined to a minimum desirable level, the system is switched back to the FIG. 2A mode of operation.

In accordance with the above technique, associated raw and spent shale beds are operated in a combustion mode and a pyrolysis mode, with the beds being switched between these two modes in cyclic fashion. By this means, the pyrolysis temperature in raw shale Bed C can be precisely controlled, since if the hot pyrolysis gas passing out of Bed B is FIG. 2B is too cold, Bed B can be switched to combustion whereby Bed B will be heated up again so that it can again produce hotter pyrolysis or retorting gas. Similarly, pyrolysis gas passing into Bed C can be prevented from becoming too hot by ensuring that the beds are switched from the combustion mode of FIG. 2A to the pyrolysis mode of FIG. 2B before too much combustion occurs in Bed B. Thus, precise control of the pyrolysis temperature in Bed C is made possible.

Also, by discharging the flue gas to waste and relying solely on the sensible heat in Bed B after combustion as the heat source for pyrolysis, contamination of the offgas product passing out of raw shale Bed C with oxygen and/or flue gas is avoided. Thus, the offgas product of the process has a relatively high BTU content, especially when the retorting gas is shale gas recovered by condensing out shale oil from the offgas product of a previously pyrolyzed bed. Furthermore, the flue gas is discharged to waste, rather than simply discharged to the atmosphere, can be processed to recover some of its heat value. For example, it can be used to power a steam generator or the like for supplying electrical or mechanical energy to the system. Alternately, it can be used to generate steam for use as part of the pyrolysis gas in accordance with one embodiment of the invention.

An additional benefit of separating the combustion function and the pyrolysis function into separate beds in comparison with conventional in situ combustion retorting according to the prior art is a significant increase in recovery of shale oil from the solid shale forming the walls, roof and floor of the rubblized shale bed. In both types of retorting of the rubblized raw shale bed by hot gases, there will be considerable heat lost to the shale in the walls, roof and floors by thermal conduction. During the operation of a commercial sized retort, which may take many months to complete pyrolysis of the kerogen therein, the shale in the walls will be heated to a temperature in excess of 500° to 600° F. to a depth of many feet and some of it to much higher temperatures. The kerogen in this solid shale heated to these temperatures will be partially or completely pyrolyzed and the resulting shale oil vapors and shale gas will flow by expansion into the bulk void spaces in the rubblized shale bed. In conventional in situ combustion retorting most of this shale oil and gas will be produced after the flame front or combustion front has passed. This shale oil and shale gas will come into contact with oxygen and be burned. However, with pyrolysis separated from combustion according to this invention, the shale oil and shale gas produced from the walls of the rubblized shale bed will be recovered. For some typical in situ retorting operations conducted according to this invention, in the rich Mahogany Zone of the Green River Shale in Colorado and Utah, the recovery of shale oil from the walls of a rubblized shale bed may be equal to 10 to 25% of the shale oil recovered from the shale in the rubblized shale bed. This recovery of additional shale oil is achieved with no extra investment and expense of mining. In addition from a conservation viewpoint, it represents a larger recovery of valuable fuels from a limited natural resource.

For simplicity, FIGS. 2A and 2B illustrate associated burned, spent and raw shale beds cycling between combustion and pyrolysis functions using constant pressure gas flows. In actual operation, gas flows into and out of Beds A, B and C during both combustion and pyrolysis will be conducted in a pressure pulsing operation. This is more fully illustrated in FIGS. 3 and 4.

FIG. 3 schematically indicates the pressure changes encountered in one full pressure pulse cycle carried out with one burned shale bed and one associated spent shale bed and operated during the combustion mode as illustrated in FIG. 2A. In the embodiment shown, the system is designed to operate at pulse pressures between atmospheric pressure, which is approximately 12 psia at the elevations of Green River Shale in Colorado and Utah, and a few psi below atmospheric pressure, for example 8 psia. In this mode of operation, a flue gas vacuum compressor is all that is needed to move gases into and out of the appropriate beds.

Figure 3A:
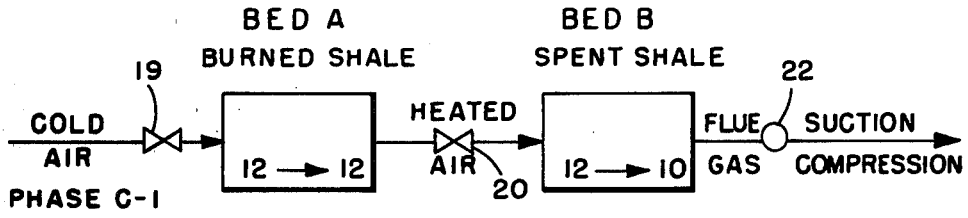
FIG. 3 is a further schematic view of a burned shale bed and an associated spent shale bed illustrating the sequential pressure swings experienced by the two beds during combustion using pressure pulsed forced convection in accordance with the present invention.
Figure 3B:
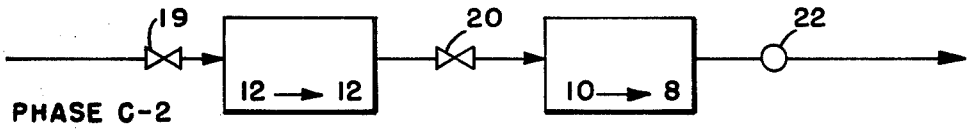
Figure 3C:
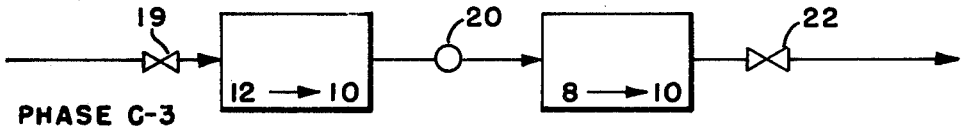
Figure 3D:
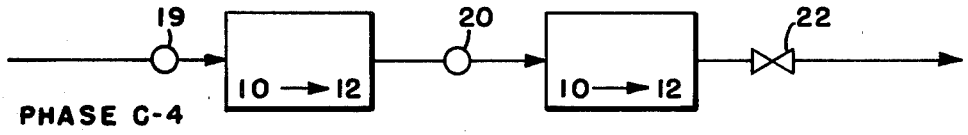
Figure 3E:
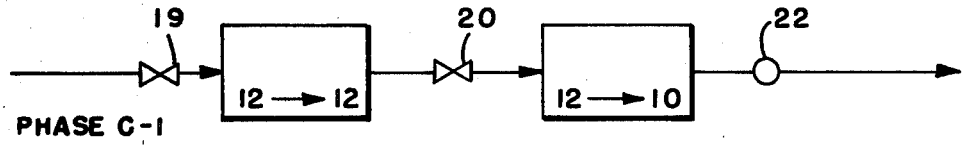

A full pressure pulsing cycle in the combustion mode is divided into four different phases reflected in FIGS. 3A, 3B, 3C, and 3D. At the beginning of phase C-1, the pressure in both burned shale Bed A and spent shale Bed B is 12 psia, which is reflected by the number 12 in the lower lefthand corner of both beds in FIG. 3A. At this time valves 19 and 20 are closed and valve 22 is opened such that spent shale Bed B is connected to a vacuum compressor, not shown. During phases C-1 and C-2, the compressor evacuates spent shale Bed B so that the pressure therein drops from 12 psia to 8 psia which is reflected by the arrows and the number 8 in the lower righthand corner of Bed B in FIG. 3B. When the pressure in spent shale Bed B reaches 8 psia, phase C-2 terminates and phase C-3 begins, which is reflected in FIG. 3C by the fact that the initial pressure in spent shale Bed B, 8 psia, now appears on the lower lefthand corner of Bed B. At the initiation of phase C-3 valve 22 is closed and valve 20 is opened so that the pressure in burned shale Bed A and the pressure in spent shale Bed B are equalized at a pressure of about 10 psia. This equalization of pressures in Bed A and Bed B permits some of the benefits of pressure pulsing in improving contacting of more of the burned shale by cold air to be achieved without additional vacuum compression to reduce pressure in Bed A to the lowest pressure of 8 psia attained in spent shale Bed B. At that time, Phase C-4 begins. As illustrated in FIGS. 3D, valve 19 is opened to permit cold air to be drawn into burned shale Bed A and heated air to be drawn into spent shale Bed B until the pressure in both beds has reached 12 psia. When phase C-4 is completed, both burned shale Bed A and spent shale Bed B are at 12 psia, ready for the start of a new pressure pulsing cycle as illustrated in FIG. 3E, which is identical to FIG. 3A.

The above illustrates how an associated pair of burned and spent shale beds are processed in accordance with the present invention by pressure pulsing during the combustion mode of operation. Air is drawn into burned shale Bed A where it picks up heat in Phase C-3 and then into spent shale Bed B where it causes combustion of char. In phase C-1 the combustion gases are drawn out of spent shale Bed B. Thus, the preheating of air by sensible heat in burned shale Bed A and heating of spent shale by the combustion of char in spent shale Bed B are accomplished entirely by forced convection carried out by the pressure pulsing technique.

A similar technique is employed in accordance with the invention during the pyrolysis mode of operation. This is more fully illustrated in FIG. 4 which schematically indicates the pressure changes encountered in one full pressure pulse cycle, carried out with one spent shale bed and one associated raw shale bed and operated during the pyrolysis mode as illustrated in FIG. 2B. In the embodiment shown, the system is designed to operate at pulse pressures between atmospheric pressure of about 12 psia, and a few pounds below atmospheric pressure, for example 8 psia. In this mode of operation, a pyrolysis gas vacuum compressor is all that is needed to move gases into and out of the various beds.

A full pressure pulsing cycle in the pyrolysis mode is divided into four different phases which are reflected in FIGS. 4A, 4B, 4C and 4D. At the beginning of phase P-1, the pressure in both spent shale Bed B and raw shale Bed C is 12 psia, which is reflected by the number 12 in the lower lefthand corner of both beds in FIG. 4A. At this time, valves 20 and 22 are closed and valve 24 is opened so that raw shale Bed B is connected to a vacuum compressor, not shown. During phase P-1, the compressor evacuates raw shale Bed C so that the pressure therein drops from 12 psia to 8 psia, which is reflected by the arrow and the number 8 in the lower righthand corner of Bed C of FIG. 4A. When the pressure in raw shale Bed C reaches 8 psia, phase P-1 terminates and phase P-2 begins, which is reflected in FIG. 4B by the fact that the initial pressure is raw shale Bed C, 8 psia, now appears on the lower lefthand corner of Bed C. At the initiation of phase P-2, valve 22 is opened so that the pressure in spent shale Bed B also drops to 8 psia. Of course, the pressure in raw shale Bed C will increase somewhat when valve 22 is opened but at the termination of phase P-2 the pressure in raw shale Bed C will again be 8 psia. It will thus be noted that after the first two phases of a single pressure pulse cycle, both beds have been depressurized from 12 to 8 psia with gases from hot spent shale Bed B being transferred to raw shale Bed C for pyrolysis of the kerogen therein.

Figure 4A:
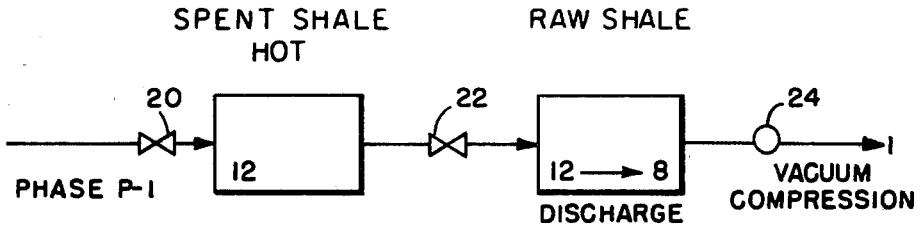
FIG. 4 is a further schematic view of a spent shale bed and an associated raw shale bed illustrating the sequential pressure swings experienced by the two beds during a pressure pulsing cycle in the pyrolysis mode of operation in accordance with the present invention.
Figure 4B:
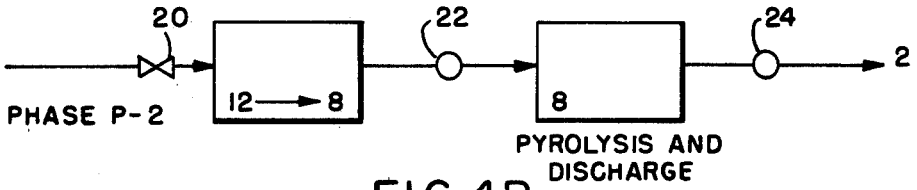
Figure 4C:
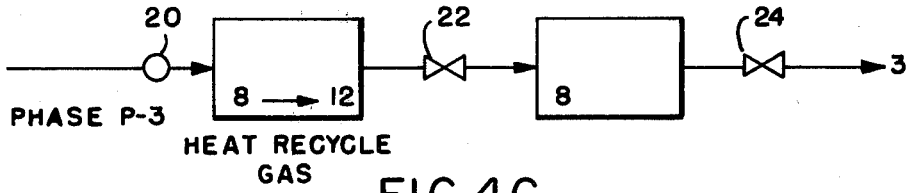
Figure 4D:
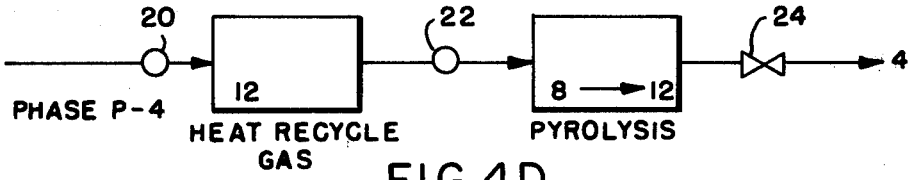
Figure 4E:
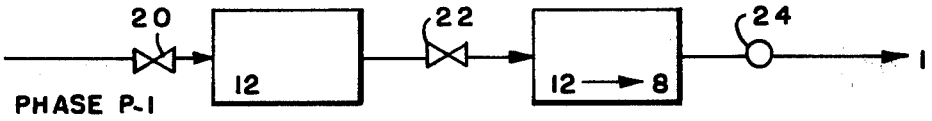

Phases P-3 and P-4 of the pressure pulsing cycle represent repressurization. In phase P-3, valves 22 and 24 are closed while valve 20 is opened. Because of the low pressure in spent shale Bed B, retorting gas at essentially atmospheric pressure is drawn through valve 20 and into Bed B until the pressure therein increases to about 12 psia. Then, as shown in FIG. 4D, valve 22 is opened so that the pressure in raw shale Bed C increases to 12 psia at the end of phase P-4. When phase P-4 is completed, both spent shale Bed B and spent shale Bed C are at 12 psia, ready for the start of a new pressure pulsing cycle as illustrated in FIG. 4E, which is identical to FIG. 4A.

The above illustrates how an associated pair of raw and spent oil shale beds are processed in accordance with the present invention. Oxygen-free retorting gas is drawn into spent shale Bed B where it picks up heat in phase P-3 and then into raw shale Bed C where it causes pyrolysis in phase P-4. In phase P-1 the pyrolysis product together with the retorting gas is drawn out of raw shale Bed B followed in phase P-2 by drawing additional amounts of heated retorting gas into raw shale Bed C for additional pyrolysis. Thus, the transfer of heat from spent shale Bed B to raw shale Bed C is accomplished entirely by forced convection carrying out with the pressure pulsing technique.

In order to carry out the inventive process as economically as possible, it is desirable to operate so that the vacuum compressors needed for forced convection are in use at all times. In the two-bed system illustrated in FIGS. 3 and 4, the compressors are employed only about half the time, that is in phases C-1, P-1 and P-2. Accordingly, in the preferred embodiment of the invention, pairs of spent shale Beds B and raw shale Beds C are associated with one another, the two spent shale beds and the two raw shale beds being operated in directly opposite phases so that the pyrolysis gas vacuum compressor will be used at all times. Similarly pairs of burned shale Beds A and spent shale Beds B are associated with one another, the two burned shale beds and the two spent shale beds being operated in directly opposite phases so that the flue gas vacuum compressor will be used at all times.

Figure 5:
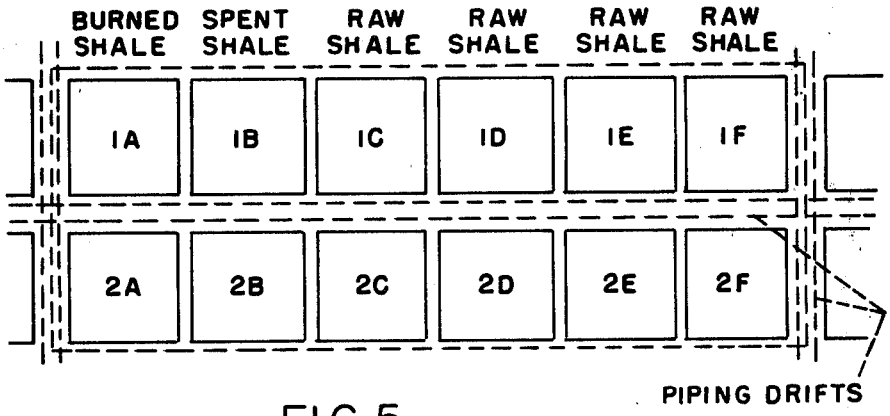
FIG. 5 is a schematic view illustrating the layout of a series of beds in a single panel.

This is more fully illustrated in FIG. 5 which shows a panel of 12 beds arranged in two rows of six each. Oppositely facing beds in each row are subjected to the same operation but in opposite phases of the same pressure pulsing cycle. For example, when Bed 1B is in phase C-1 for exhaustion of flue gas, Bed 2B will be in phase C-3 for combustion of char, then when Bed 1B is in phase C-2, Bed 2B will be in phase C-4, and so forth. Similarly, when Beds 1B and 1C are in phase P-1 of heat transfer and pyrolysis, Beds 2B and 2C will be in phase P-3. Then when Beds 1B and 1C are in phase P-2, Beds 2B and 2C will be in phase P-4. Since the beds of rows 1 and 2 are operated directly out of phase from one another, all of the beds can be serviced by a single combustion gas vacuum compressor and a single pyrolysis gas compressor which will be operating full-time.

Figure 6:
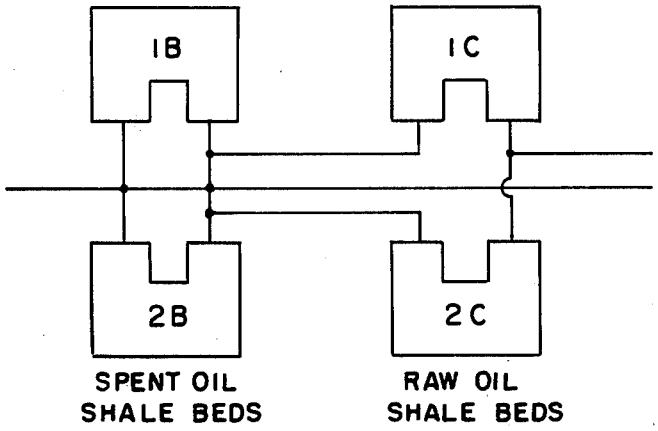
FIG. 6 is a schematic view illustrating a preferred arrangement and shape of beds and associated piping in a bed panel.

FIG. 6 further illustrates the arrangement of beds in the preferred embodiment of the invention as described in connection with FIG. 5. In order to minimize piping requirements, bed pairs are arranged facing one another so that only a single system of pipes is needed to service two rows of beds. Furthermore, the beds are formed in a horseshoe shape so that the inlets and outlets of like pairs of beds are facing one another. Not only are valving requirements for pressure pulsing simplified by this arrangement, but also heat loss during heat transfer is minimized. A suitable piping arrangement for carrying out all of the operations with this arrangement of beds is shown in the figure. The horseshoe-shaping of beds to eliminate an extra row of piping is the invention of another.

Figure 7:
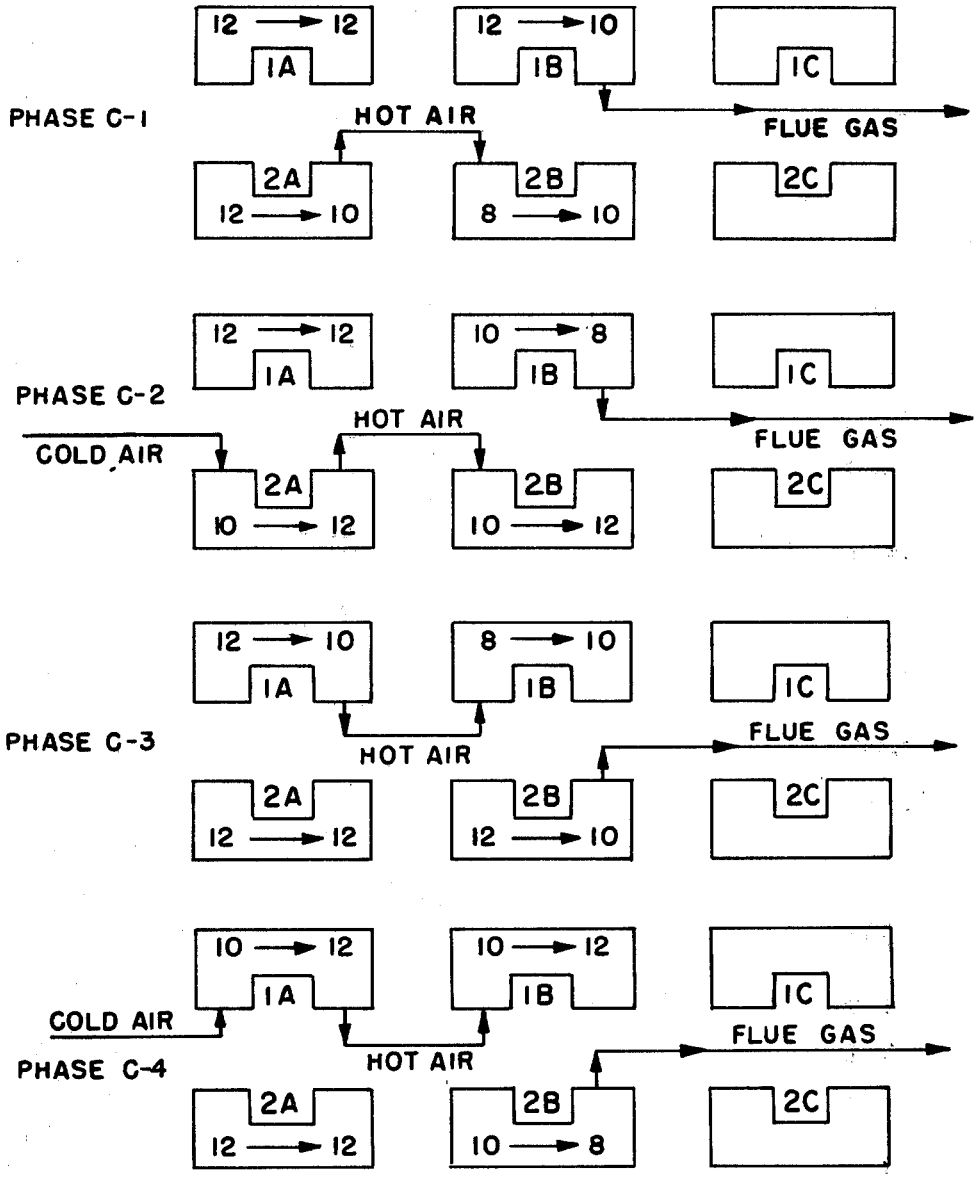
FIG. 7 is a schematic view illustrating the pressure pulsing operation of the invention carried out on the beds of FIG. 5 during the combustion mode of the present invention.
Figure 8:
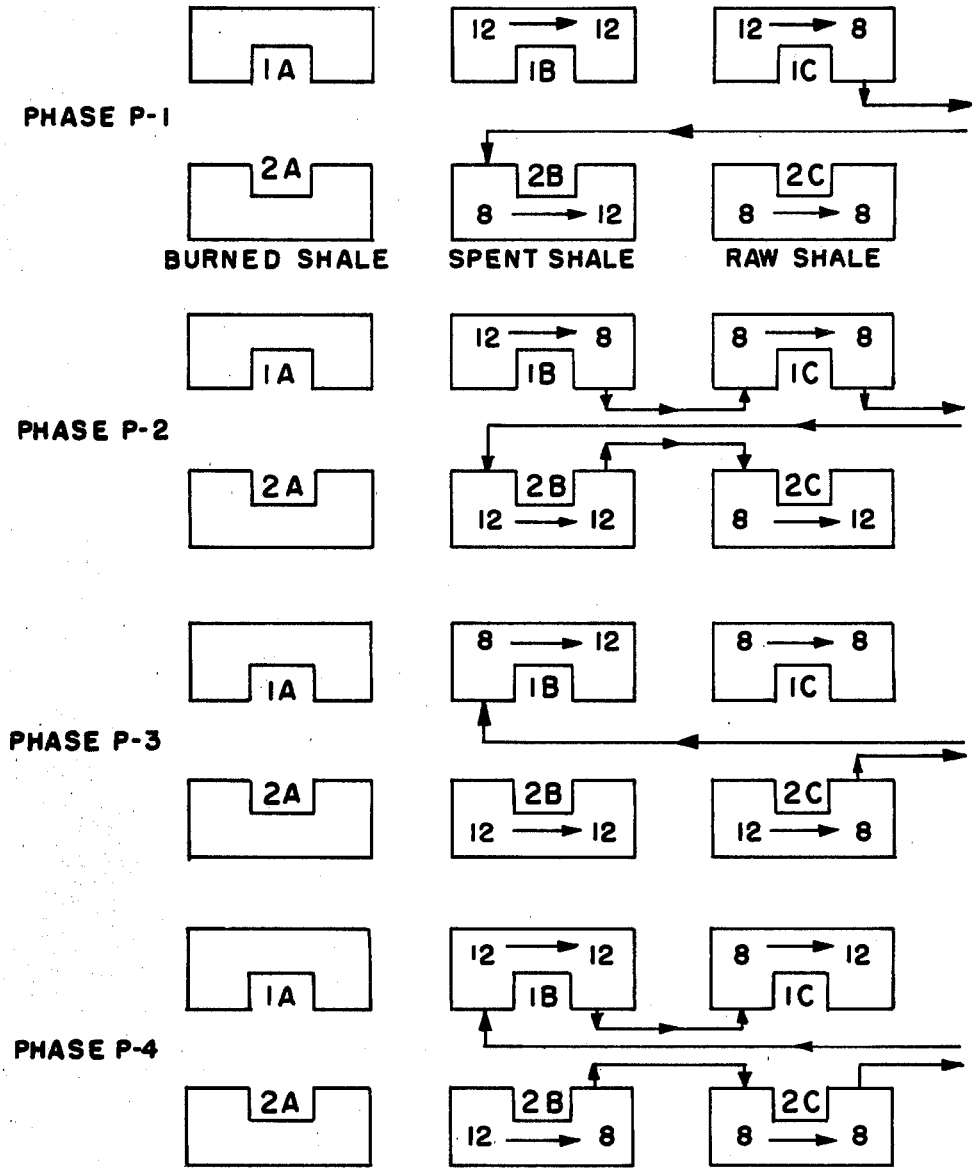
FIG. 8 is a schematic view illustrating the pressure pulsing operation during the combustion mode of the present invention.

FIGS. 7 and 8 illustrate operation of the preferred embodiment of the inventive process when using the preferred arrangement of beds as illustrated in FIGS. 5 and 6 with pressure pulsing sequences as illustrated in FIGS. 3 and 4. FIG. 7 illustrates system operation during the air preheat and combustion mode of operation of FIG. 2A while FIG. 8 illustrates operation during the heat transfer and pyrolysis mode of FIG. 2B.

Turning to FIG. 7, in phase C-1 of operation, both Beds 1A and 1B start at atmospheric pressure of about 12 psia while Bed 2A is at 12 psia and Bed B is at about 8 psia. The valves in the piping system are arranged so that during phase C-1, flue gas in Bed 1B is withdrawn therefrom until the pressure reaches 10 psia while Beds 2A and 2B are connected to one another so that the pressures therein equalize at about 10 psia. In phase C-2 additional flue gas is withdrawn from Bed 1B until the pressure drops to 8 psia and cold air is allowed to enter Bed 2A so that the pressure in both Beds 2A and 2B increases to 12 psia, the cold air being withdrawn from access drifts or adits. In phase C-3, Bed 1B is connected to Bed 1A so that preheated air in Bed 1A is drawn into Bed 1B until the pressures in the two beds equalize at about 10 psia. In phase C-4, Bed 1A is opened to air at atmospheric pressure in the drifts providing access to the various rubblized shale beds. Cold air then is drawn into Bed 1A displacing hot air into Bed 1A until pressures in both beds have equalized at 12 psia. Meanwhile, during both phases C-3, and C-4, the valving is switched so that flue gas is drawn out of Bed 2B instead of 1B.

By this means, it can be seen that air preheated in each burned shale bed is supplied to its associated spent shale bed for combustion of char therein by a forced convection technique which employs pressure pulsing to maximize transfer of heat out of the burned shale bed into the spent shale bed and to maximize contcat of this air with char for combustion to increase the temperature in the spent shale bed. In addition, this is accomplished using a single flue gas vacuum compressor operated continuously.

In carrying out heat transfer and pyrolysis during the pyrolysis mode of the invention, a similar procedure is employed. Referring to FIG. 8, in phase P-1 of operation, both Beds 1B and 1C start at atmospheric pressure of about 12 psia while both Beds 2B and 2C start at about 8 psia. The valves in the piping system are arranged so that during phase P-1, gas in raw shale Bed 1C is withdrawn therefrom until the pressure reaches 8 psi while at the same time cold retorting gas is drawn into spent shale Bed 2B until its pressure reaches 12 psi. In phase P-2, Bed 1B is connected to Bed 1C and Bed 2B is connected to Bed 2C so that the heated retort gas in Bed 1B is drawn into Bed 1C and the heated retorting gas in Bed 2B is drawn into Bed 2C. In phase P-3, the valving is switched so that product gas is drawn out of Bed 2C instead of Bed 1C and further so that incoming cold retorting gas is drawn into Bed 1B instead of Bed 2B. When the pressures in Beds 1B and 2C reach their desired value at the end of phase P-3, the connection between Beds 1B and 1C and 2B and 2C are opened so that Beds 1C and 2B are charged and discharged, respectively.

By this means, it can be seen that each raw shale bed is heated exclusively using the sensible heat recovered from its associated spent shale bed by a forced convection technique which employes pressure pulsing to maximize transfer of heat out of the spent shale bed and into the raw shale bed as well as transfer of vaporous shale oil and gases out of the raw shale beds. In addition, this is accomplished using a single vacuum compressor operated continuously.

As previously indicated, a significant aspect of the invention is that the maximum pyrolysis temperature is precisely controlled. This is accomplished as follows. Heat transfer and pyrolysis of an associated pair of raw shale oil beds as shown in FIG. 8 will continue until the temperature of spent shale Beds 1B and 1C drops too low to provide enough heat for the pyrolysis operation. Depending upon the size of the beds, this may take on the order of 10 to 20 days based on pressure pulsing cycles of approximately 5 to 15 minutes per cycle. At this time, retorting is terminated and the combustion operation commenced, combustion being carried out in accordance with the system illustrated in FIG. 7. Combustion is continued until the temperature of spent shale Beds 1B and 2B reaches a sufficiently high level at which time the system is switched back to a retorting mode.

Figure 9:
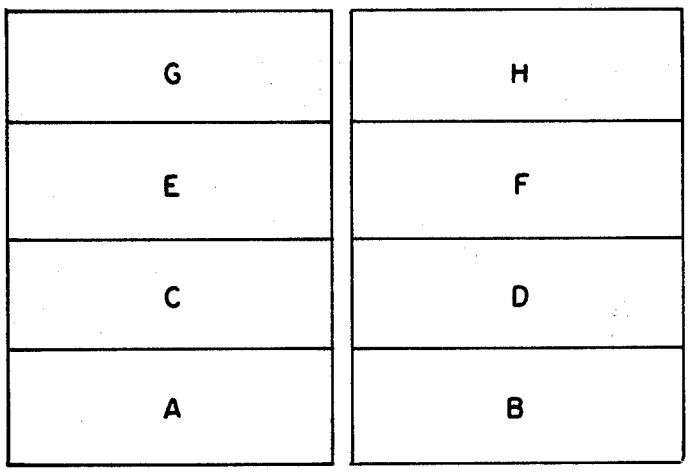
FIG. 9 is a schematic view illustrating the arrangement of a number of panels of beds in association with a single gas-treating plant.

FIG. 9 illustrates the overall layout of a number of panels of beds to be processed as illustrated in FIG. 5 as well as the preferred location of a single gas treatment plant needed to service all of the different beds. A major cost associated with carrying out the inventive process is the capital costs for piping and the gas treatment plant. The arrangement in FIG. 6 enables a large number of beds to be processed with only a single gas treatment plant and a minimal amount of piping.

The preferred embodiment of this invention involves simultaneous operations in two nearby panels of retorts. For example, air preheating and combustion of char could be carried out in Beds 1A, 1B, 2A and 2B (outlined in detail in FIG. 5) in Panel A of FIG. 6 while heat transfer and pyrolysis of kerogen is in operation in Beds 1B, 2B, 1C and 2C in Panel C of FIG. 6. When pyrolysis in Beds 1C and 2C of Panel C is completed, the valving of lines in both panels will be changed to utilize Beds 1B and 2B for air preheating, Beds 1C and 2C for combustion of char, heat storage and heat transfer, and Beds 1D and 2D for pyrolysis. When pyrolysis of a set of raw shale beds is completed, the functions of beds will be advanced in a similar manner until all beds in Panels A and C have been processed. Then the underground piping will be moved to process beds in Panels B and D and successively into Panels E and G and finally into Panels F and H.

In one embodiment of the invention as discussed above, pressure pulsing is accomplished such that the maximum pressure encountered in the pressure pulsing cycle is no higher than ambient pressure. Because of this, the entire pressure pulsing operation can be accomplished with a single flue gas vacuum compressor and a single heat transfer gas product gas vacuum compressor. Furthermore, loss of process gases through cracks and fissures in the formation surrounding a bed are eliminated since the entire operation is conducted at less than ambient pressure. This is especially important from a health and environmental standpoint since this means that release of noxious gases to the atmosphere where they may harm workers is eliminated. Of course, the maximum pressure in heat transfer pressure pulsing can be slightly over ambient in the preferred embodiment without significantly losing the benefits of operating substantially below ambient pressure. Moreover, the entire pressure pulsing operation if desired can be accomplished at higher pressure, such as for example with the mean pressure being ambient. Preferably, however, the pressure pulsing operation is accomplished below ambient pressure so that the above advantages are realized.

Steam

In still another embodiment of the invention, steam is used solely as or as part (e.g. 20 to 30%) of the pyrolysis gas. The use of steam or low pressure water vapor as a heat transfer medium in both above ground and retorts and in modified in situ retorts is known. Laboratory pyrolysis of very fine oil shale powders or small pieces of shale of the order of 1/16 inch to ¼ inch indicates more efficient conversion of kerogen to shale oil when retorting with steam than when retorting with inert gases such as nitrogen. Apparently the water vapor is actually involved in the chemical reaction of destructive distillation of the kerogen rather than merely being a heat transport medium. However, similar laboratory pyrolysis of pieces of shale one inch in diameter or larger indicates no measurable increase in conversion of kerogen to shale oil by use of steam versus use of nitrogen in the retort. All of these tests were conducted at substantially constant pressure in the retort. In accordance with this aspect of the invention, however, supplying steam (water vapor) in a pressure pulsing mode will provide intimate contact of the steam with the kerogen within the interior of the shale chunks thereby making possible the heretofore discovered benefits of steam pyrolysis on larger shale chunks which will exist in actual commercial operation of modified in situ oil shale retorts.

Low Kerogen Content Shale

In the embodiments described above, pyrolysis and combustion are carried out in separate beds and flue gas produced during combustion is not used for directly heating an unpyrolyzed bed. In these embodiments in the invention, the oil shale is rich enough in kerogen that the sensible heat remaining in pyrolyzed bed together with the net heat of char combustion (gross heat of char combustion minus heat losses due to withdrawal of fluw gas) are sufficient to provide all of the heat necessary for pyrolysis of kerogen in an associated bed. However, oil shal formations having less than roughly 20 gallons recoverable shale oil per ton shale do not contain enough heat value to accomplish this result. Nonetheless, the present invention is applicable to such shale formations, but in this instance, the combustion functions and pyrolysis functions are carried out together. In other words, in this instance, combustion retorting is carried out in a conventional manner as described above in connection with Bed A, FIG. 1, except that rather than operating at constant pressure, air is supplied and flue gas removed from the bed in a pressure pulsing mode. Thus, the advantages of combining rubblization with pressure pulsing are still realized.

Although only a few embodiments of the invention have been described above, many modifications can be made without departing from the spirit and scope of the invention. All such modifications are intended to be included within the scope of the invention, which is to be limited only by the following claims:

I claim:

1. A process for retorting a discrete bed of raw oil shale to produce shale oil therefrom comprising (a) rubblizing said bed, and thereafter (b) heating said bed to cause pyrolysis of the kerogen therein, said heating being accomplished by supplying a hot retorting gas to said bed in such a manner that the pressure in said bed cycles between higher and lower pressures, wherein said higher pressure is about 11 to 12 psia and said lower pressure is about 5 to 9 psia, whereby said hot retorting gas causes pyrolysis of said kerogen.

2. The process of claim 1 wherein said hot retorting gas is essentially oxygen free.

3. The process of claim 2 wherein prior to contact with said bed said gas is heated by contacting said gas with a spent shale bed having been previously retorted to pyrolyze the kerogen therein.

4. The process of claim 3 wherein prior to contact of said retorting gas with said spent oil shale bed, air is passed through said spent shale bed to cause combustion of the char therein, and generation of flue gas, said flue gas being discharged without contacting said retorting gas.

5. The process of claim 4 wherein said retorting gas is supplied to said bed by forced convection, said flue gas being employed as a source of energy for powering said forced convection.

6. The process of claim 5 wherein said flue gas is employed to drive a steam generator for the production of electricity, said electricity being employed to drive a compressor for causing said forced convection.

7. In a process for retorting a raw oil shale bed in which heat for retorting said bed is supplied from a spent oil shale bed having been previously retorted, said heat being supplied by contacting said retorting gas with said spent shale bed to heat said retorting gas and thereafter contacting said heated retorting gas with said raw shale bed, the improvement comprising (a) contacting said spent oil shale bed with air to cause combustion of char therein to thereby heat said spent shale bed and generate flue gas, and (b) discharging said flue gas without mixing with said retorting gas, prior to contacting said retorting gas with said spent shale oil bed.

8. The process of claim 7 wherein prior to contact of said spent oil shale bed with air, said air is heated by contact with a burned shale bed having been previously retorted and contacted with air to cause combustion of the char therein.

9. The process of claim 7 wherein said retorting gas is supplied to said bed by forced convection, said flue gas being employed as a source of energy for powering said forced convection.

10. The process of claim 9 wherein said flue gas is employed to drive a steam generator for the production of electricity, said electricity being employed to drive a compressor for causing said forced convection.

11. A process for retorting a pair of discrete raw oil shale beds, each raw shale bed being associated with a spent shale bed having been previously retorted and containing pyrolysis char capable of being combusted by contact with air, a first of said raw shale beds and a first spent shale bed associated therewith being at an upper pressure and the second of said raw shale beds and the second spent shale bed associated therewith being at a lower pressure lower than said upper pressure, said process comprising (1) withdrawing gas from said first raw shale oil bed until the pressure therein drops to about said lower pressure, (2) simultaneously with step (1) allowing the pressure in said second spent shale bed to increase to about said upper pressure by supplying an essentially oxygen-free gas thereto, (3) thereafter continuing to withdraw gas from said first raw shale bed and opening communication between said first raw shale bed and said first spent shale bed so that gas in said first spent shale bed is drawn into said first raw shale bed, step (3) continuing until the pressure in said first spent shale bed drops to about said lower pressure, and (4) simultaneously with step (3) opening communication between said second spent shale bed and said second raw shale bed so that gas in said second spent shale oil bed is drawn into said second raw shale bed, step (4) continuing until the pressure in said second raw shale bed reaches about said upper pressure.

12. The process of claim 11 further comprising (5) withdrawing gas from said second raw shale bed until the pressure therein drops to about said lower pressure, (6) simultaneously with step (5) supplying an essentially oxygen-free gas to said first shale bed until the pressure therein increases to about said upper pressure, (7) thereafter continuing to withdraw gas from said second raw shale bed and opening communication between said second raw shale bed and said second spent shale bed so that gas in said second spent shale bed is drawn into said second raw shale bed, step (7) continuing until the pressure in said second spent shale bed drops to about said lower pressure, and (8) simultaneously with step (7) opening communication between said first spent shale bed and said first raw shale bed so that gas in said first spent shale oil bed is drawn into said first raw shale bed, step (8) continuing until the pressure in said first raw shale bed reaches about said upper pressure.

13. The process of claim 12 wherein said upper pressure is no more than about 3 psi greater than ambient.

14. The process of claim 13 wherein said upper pressure is about ambient.

15. The process of claim 14 wherein gas is withdrawn from said first and said second raw shale beds from a single low pressure source.

16. A process for recovering shale oil from a plurality of rubblized oil shale beds arranged in sets of four, each of said sets comprising a pair of spent shale beds containing char and a pair of raw shale beds containing kerogen, a first of said spent shale beds associating with a first of said raw shale beds and the second of said spent shale beds associating with the second of said raw shale beds, said process comprising combusting char in said spent shale beds in a combustion mode and pyrolyzing the kerogen in said raw shale bed in a pyrolysis mode, said kerogen being pyrolyzed with heat generated from combustion of char in said combustion mode, said combustion mode comprising at least one cycle of first and second combustion phases wherein air is passed into said spent shale beds to cause combustion of the char therein and heating of said spent shale beds, said first combustion phase comprising passing air into said first spent shale bed so that the gas pressure therein increases and withdrawing flue gas from said second spent shale bed so that the gas pressure therein decreases, said second combustion phase comprising passing air into said second spent shale bed so that the gas pressure therein increases and withdrawing flue gas from said spent shale bed so that the gas pressure therein decreases, said pyrolysis mode comprising at least one cycle of first, second, third and fourth pyrolysis phases carried out in order wherein heat in said spent shale bed is transferred by forced convection to raw shale beds to pyrolyze the kerogen therein and produce an offgas product containing pyrolysis gas and shale oil vapors, said first pyrolysis phase comprising passing pyrolysis gas into said first spent shale bed so that the gase pressure therein increases and withdrawing offgas product from said second raw shale bed so that the pressure therein decreases, said second pyrolysis phase comprising passing pyrolysis gas in said first spent shale bed to said first raw shale bed so that the pressure therein increases and passing pyrolysis gas from said second spent shale bed to said second raw shale bed so that the pressure in said second spent shale bed decreases, said third pyrolysis phase comprising passing pyrolysis gas into said second spent shale bed so that the pressure therein increases and withdrawing offgas product from said first raw shale bed so that the pressure therein decreases, and said fourth pyrolysis phase comprising transferring pyrolysis gas from said first spent shale bed to said first raw shale bed so that the pressure in said first spent shale bed decreases and transferring pyrolysis gas from said second spent shale bed to said second raw shale bed so that the pressure in said second raw shale bed increases.

17. The process of claim 16 further comprising (a) passing pyrolysis gas into said first spent shale bed and withdrawing product gas from said second raw shale bed during said second pyrolysis phase, and (b) withdrawing offgas product from said first raw shale bed and passing pyrolysis gas into said second spent shale bed during said fourth pyrolysis phase.

18. The process of claim 17 wherein said combustion mode comprises at least two cycles of combustion phases and further wherein said pyrolysis mode comprises at least two cycles of first, second, third and fourth pyrolysis phases.

19. The process of claim 18 wherein said shale beds are subjected to said combustion mode and said pyrolysis mode cyclicly, said shale beds being switched from said combustion mode to said pyrolysis mode when the temperature in said spent shale beds increases to a predetermined value, said beds being switched from said pyrolysis mode to said combustion mode when the temperature of the pyrolysis gas passing from said spent shale beds to said raw shale beds decreases to a predetermined value.

20. The process of claim 16 wherein said pyrolysis gas comprises steam.

21. The process of claim 20 wherein the steam content of said pyrolysis gas is about 20 to 30%.

22. The process of claim 16 wherein said pyrolysis gas is shale oil vapors produced by removing shale oil from the offgas product of a previously pyrolyzed bed.

23. A process for retorting a discrete bed of raw oil shale to produce shale oil therefrom comprising (a) rubblizing said bed, and thereafter (b) heating said bed to cause pyrolysis of the kerogen therein, said heating being accomplished by supplying an essentially oxygen-free hot retorting gas to said bed in such a manner that the pressure in said bed cycles between higher and lower pressures, whereby said hot retorting gas causes pyrolysis of said kerogen, wherein said retorting gas is heated by contact with a spent shale bed having been previously retorted to pyrolyze the kerogen therein and wherein prior to contacting said retorting gas with said spent shale bed, air is passed through said spent shale bed to cause combustion of the char therein, and generation of flue gas, said flue gas being discharged without contacting said retorting gas.

24. The process of claim 23 wherein said retorting gas is supplied to said bed by forced convection, said flue gas being employed as a source of energy for powering said forced convection.

25. The process of claim 23 wherein said flue gas is employed to drive a steam generator for the production of electricity, said electricity being employed to drive a compressor for causing said forced convection.

* * * * *